US008173338B2

(12) United States Patent
Bellino et al.

(10) Patent No.: US 8,173,338 B2
(45) Date of Patent: May 8, 2012

(54) PHOTOCONDUCTOR SYSTEM FOR ELECTROPHOTOGRAPHIC DEVICE

(75) Inventors: Mark Thomas Bellino, Loveland, CO (US); Weimel Luo, Louisville, CO (US); Scott Daniel Reeves, Louisville, CO (US); Tanya Yvonne Thames, Aurora, CO (US)

(73) Assignee: Lexmark International, Inc., Lexington, KY (US)

( * ) Notice: Subject to any disclaimer, the term of this patent is extended or adjusted under 35 U.S.C. 154(b) by 487 days.

(21) Appl. No.: 12/369,454

(22) Filed: Feb. 11, 2009

(65) Prior Publication Data

US 2010/0203436 A1 Aug. 12, 2010

(51) Int. Cl.
*G03G 5/04* (2006.01)

(52) U.S. Cl. ..... 430/56; 430/57.3; 430/59.2; 430/59.4; 430/59.5

(58) Field of Classification Search ..... 430/56, 430/57.3, 59.2, 59.4, 59.5
See application file for complete search history.

(56) References Cited

U.S. PATENT DOCUMENTS

| | | | | |
|---|---|---|---|---|
| 2004/0101771 | A1* | 5/2004 | Azuma et al. | 430/58.85 |
| 2005/0238975 | A1* | 10/2005 | Fujiki et al. | 430/66 |
| 2007/0287084 | A1 | 12/2007 | Bellino | |
| 2008/0138726 | A1* | 6/2008 | Vong et al. | 430/58.8 |
| 2009/0005555 | A1* | 1/2009 | Wu | 540/145 |
| 2009/0232551 | A1* | 9/2009 | Nagao et al. | 399/159 |

* cited by examiner

*Primary Examiner* — Hoa V Le

(57) ABSTRACT

An electrophotographic photoconductor system for use in an electrophotographic device and method of using the same. The electrophotoconductor system comprises an electroconductive support, a charge generation layer disposed on the electroconductive support, and a charge transport layer disposed on the charge generation layer. The charge generation layer includes a photosensitive material comprising titanyl phthalocyanine, and at least one oligomeric phenylene additive. The electrophotographic photoconductor system is capable of absorbing light having a wavelength of about 350 nm to about 850 nm.

5 Claims, 5 Drawing Sheets

PHOTOCONDUCTOR SYSTEM FOR ELECTROPHOTOGRAPHIC DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to an electrophotographic photoconductor system for use in an electrophotographic device, and more specifically, to an electrophotographic photoconductor system that includes a charge generation layer capable of absorbing light having a wavelength of about 350 nanometers (nm) to about 850 nm.

2. Description of the Related Art

An electrophotographic device is usually employed to form an image on a media sheet. Suitable examples of the electrophotographic device include laser printer, copying machine, multifunctional peripheral, and the like. Suitable examples of the media sheet include, but are not limited to, textile substrates, non-woven substrates, canvas substrates, and cellulose substrates.

A typical electrophotographic device includes an electrophotographic photoconductor system (hereinafter referred to as a "photoconductor system") capable of generating latent electrostatic images thereon. The photoconductor system includes an electroconductive support, a charge generation layer disposed onto the electroconductive support, and a charge transport layer disposed on the charge generation layer. Such a photoconductor system may be categorized as a dual-layer negative-charging photoconductor system.

The electroconductive support is capable of providing a conducting support to the photoconductor system. Typically, the electroconductive support is in form of a drum composed of either polymeric materials or metallic materials.

The charge generation layer is capable of generating charge by absorbing light (such as a laser light or light emitted by light emitting diodes). More specifically, the charge generation layer includes a photosensitive material dispersed in a binder, wherein the photosensitive material is capable of generating electron-hole pairs by absorbing the light.

The charge transport layer is capable of transferring the charge generated by the charge generation layer to a surface of the photoconductor system. More specifically, the charge transport layer is composed of one or more charge transport compounds and is capable of transferring either holes or electrons generated by the charge generation layer to the surface of the photoconductor system. For the photoconductor system, which is categorized as the dual-layer negative-charging photoconductor system, the charge transport layer transfers the holes to the surface of the photoconductor system, and the electrons to the electroconductive support.

During a typical image forming process, the photoconductor system is charged to a predetermined voltage. The charging of the photoconductor system makes it sensitive to light.

Thereafter, light provided by a light emitting unit, which includes a light source for producing the light of a particular wavelength and a lens for modulating the light, irradiates the surface of the photoconductor system in a predetermined pattern. Usually, such a predetermined pattern is in accordance with the image that is required to be generated onto the surface of the photoconductor system.

The light that irradiates the surface of the photoconductor system is then absorbed by the photoconductor system. More specifically, the charge generation layer of the photoconductor system absorbs photons of the light thereby generating electron-hole pairs therewithin. Thereafter, the charge transport layer transfers the electrons to the electroconductive support and the holes from the charge generation layer to the surface of the photoconductor system.

At the surface of the photoconductor system, the holes dissipate the charge present on particular areas to form a latent electrostatic image thereon. The latent electrostatic image is thereafter toned and the toned image is transferred, either directly or through an intermediate transfer member, and fused onto the media sheet to generate the image.

During the image forming process, light having high wavelength, in the region of about 700 nanometers (nm) to about 800 nm, is usually employed to irradiate the photoconductor system. However, it is highly desirable to employ light having low wavelength, typically in the region of 350 nm to about 500 nm, for providing higher print resolutions during the image forming process. This may be appreciated by considering the following expression for spot diameter, which measures degree of print resolution:

$$d=(\pi/4)*(\lambda f/D)$$

In the expression, as stated above, "d" denotes spot diameter of a spot generated at surface of a photoconductor system, "λ" denotes wavelength of light employed for generating the spot, "f" denotes focal length of lens used to modulate the light and "D" denotes diameter of the lens. Therefore, it may be observed that a low wavelength of the light helps forming spots of small diameters, and correspondingly provides a better print resolution.

Further, due to the recent surge in use of high-density storage mediums, such as Digital Video Disc (DVD), the demand for light having a wavelength, such as a wavelength of about 650 nm, has increased tremendously. In addition, due to a high demand of technologies, such as Blu-ray and high-definition technology (HD-DVD), the manufacturing costs associated with Gallium nitride (GaN) laser light and aluminum-gallium-indium-nitride (AlGaInN) laser light (which typically have a wavelength of around 405 nm), have reduced enormously. Such an increased demand of technologies employing light having shorter wavelengths, has spurred the development of photoconductor systems that are capable of absorbing light having a shorter wavelength, such as wavelength ranging from about 350 nm to about 850 nm.

Moreover, in most of conventional photoconductor systems, the charge transport layer begins to absorb light having low wavelength, such as a wavelength ranging from about 350 nm to about 500 nm. More specifically, the charge transport layer absorbs photons of the light having low wavelength, and such a property of the charge transport layer effectively lowers the efficiency of the charge generation layer by lowering photon count at the charge generation layer. Further, it is also observed that an extended exposure of the charge transport layer with light having low wavelength may lead to a gradual photo-induced degradation of the photoconductor system. Therefore, it is important to select a charge transport layer that absorbs negligible amount of radiation when exposed to light having low wavelength.

Therefore, there is a need for developing a photoconductor system that includes a charge generation layer, which exhibits large absorption of light having wavelength of about 350 nm to about 850 nm. Further, the photoconductor system should be capable of producing images with high print resolution when employed in the electrophotographic device.

SUMMARY OF THE DISCLOSURE

In view of the foregoing disadvantages inherent in the prior art, the general purpose of the present disclosure is to provide an electrophotographic photoconductor system for use in an electrophotographic device, to include all the advantages of the prior art, and to overcome the drawbacks inherent therein.

In one aspect, the present disclosure provides an electrophotographic photoconductor system for use in an electrophotographic device. The electrophotographic photoconductor system includes an electroconductive support, a charge generation layer disposed on the electroconductive support, and a charge transport layer disposed on the charge generation layer. The charge generation layer includes a photosensitive material comprising titanyl phthalocyanine, and at least one oligomeric phenylene additive. The electrophotographic photoconductor system is capable of absorbing light having a wavelength of about 350 nm to about 850 nm.

In another aspect, the present disclosure relates to a charge generation layer for an electrophotographic device. The charge generation layer comprises a photosensitive material comprising titanyl phthalocyanine and at least one oligomeric phenylene additive. The charge generation layer is capable of absorbing light having a wavelength of about 350 nm to about 850 nm.

In yet another aspect, the present disclosure relates to a method for forming an image in an electrophotographic device. The method includes providing an electrophotographic photoconductor system, which includes an electroconductive support, a charge generation layer disposed on the electroconductive support, and a charge transport layer disposed on the charge generation layer. The charge generation layer includes a photosensitive material comprising titanyl phthalocyanine, and at least one oligomeric phenylene additive. Further, the method includes charging the electrophotographic photoconductor system and irradiating the electrophotographic photoconductor system with light having a wavelength of about 350 nm to about 850 nm to form an electrostatic latent image on the electrophotographic photoconductor system. The electrostatic latent image is thereafter developed to form a toner image and the toner image is then transferred onto a media sheet to form the image thereon.

BRIEF DESCRIPTION OF THE DRAWINGS

The above-mentioned and other features and advantages of this present disclosure, and the manner of attaining them, will become more apparent and the present disclosure will be better understood by reference to the following description of embodiments of the present disclosure taken in conjunction with the accompanying drawings, wherein.

DETAILED DESCRIPTION

Figure 1:
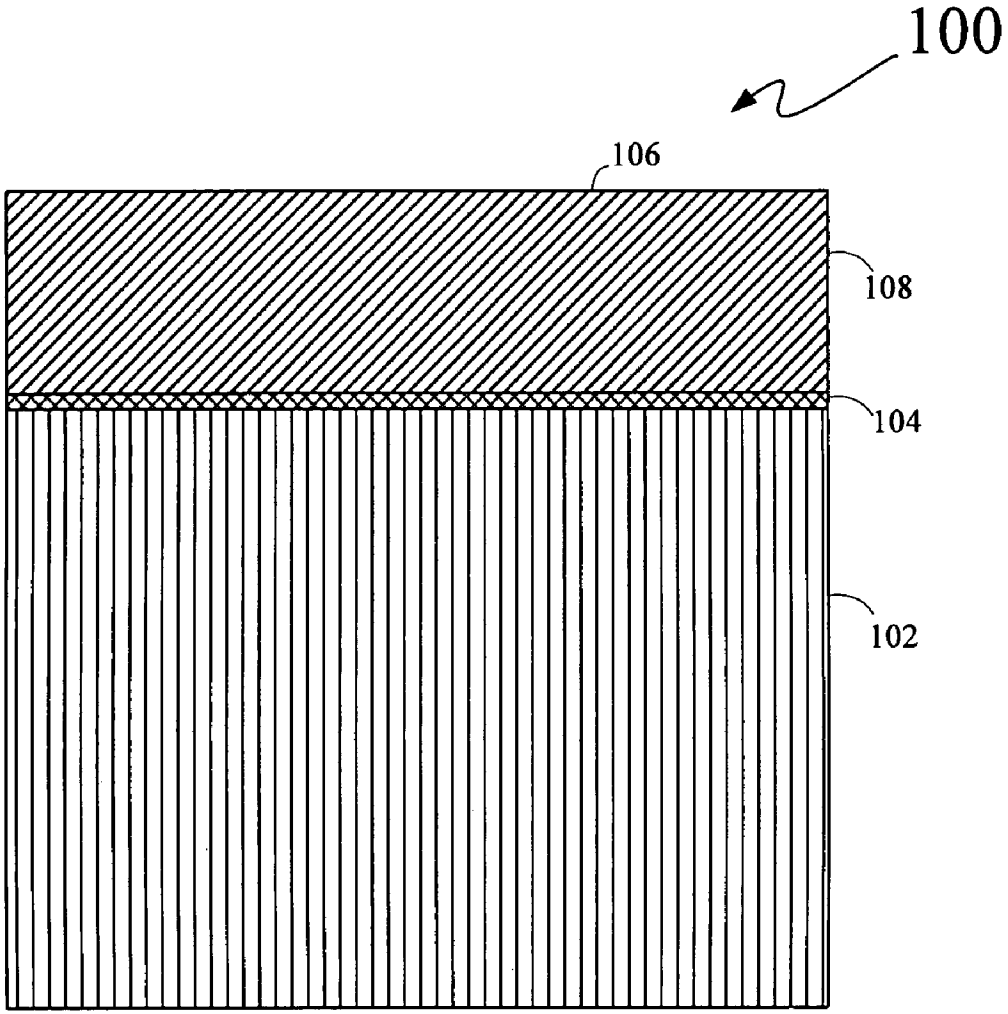
FIG. 1 is a cross-sectional view of an electrophotographic photoconductor system, according to an exemplary embodiment of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including", "comprising" or "having" and variations thereof herein is meant to encompass the items listed thereafter and equivalents thereof as well as additional items.

The present disclosure provides an electrophotographic photoconductor system for use in electrophotographic devices. It will be apparent to those skilled in the art that the electrophotographic photoconductor system is employed in a media processing device, such as laser printer, copying machine, and multifunctional peripheral, to generate an image on a media sheet. The electrophotographic photoconductor system includes an electroconductive support, a charge generation layer disposed onto the electroconductive support, and a charge transport layer disposed on the charge generation layer. Specifically, the electrophotographic photoconductor system of the present invention is a dual-layer negative-charging organic photoconductor system. The charge generation layer includes a photosensitive material that includes titanyl phthalocyanine and at least one oligomeric phenylene additive. The electrophotographic photoconductor system is explained in conjunction with FIG. 1.

FIG. 1 is a cross-sectional view of an electrophotographic photoconductor system, according to an embodiment of the present disclosure. Electrophotographic photoconductor system 100 may hereinafter be referred to as "photoconductor system 100."

As shown in FIG. 1, photoconductor system 100 includes an electroconductive support 102. Electroconductive support 102 is employed in photoconductor system 100 to provide a conductive support thereto. Further, electroconductive support 102 may be in the form of a drum or a roll (such as a cylindrical roll). Furthermore, electroconductive support 102 may be composed of a metal, such as aluminum and copper; an alloy, such as stainless steel; or a polymer, such as Mylar. However, for the purpose of this description, electroconductive support 102 is in the form of an anodized drum composed of aluminum.

Photoconductor system 100 further includes a charge generation layer 104 disposed onto electroconductive support 102. More specifically, charge generation layer 104 is deposited onto electroconductive support 102 using a coating technique, such as a dip coating technique, to form a layer of charge generation layer 104 of a specific thickness. Such a layer of charge generation layer 104 may then be dried using methods known in the art. For the purpose of this description, the thickness of charge generation layer 104 is about 0.05 microns to about 5.0 microns. Preferably, the thickness of charge generation layer 104 may be from about 0.2 microns to about 0.5 microns. It should be understood that other deposition techniques, and specifically, dry deposition techniques, such as sputtering and chemical vapor deposition (CVD) may also be employed for depositing charge generation layer 104 onto electroconductive support 102.

Charge generation layer 104 is capable of absorbing light (such as a laser light or light emitted by a light emitting diode), more specifically, light having a wavelength of about 350 nanometers (nm) to about 850 nm, and even more specifically, light having a wavelength of about 350 nm to about 500 nm. The light is provided by a light source assembly (not shown in FIG. 1). The absorption of the light by charge generation layer 104 is followed by discharging of specific areas of a surface 106 of photoconductor system 100 to form an electrostatic latent image thereon. More specifically, the absorption of the light by charge generation layer 104 allows for generation of electron-hole pairs therewithin. Holes from the electron-hole pairs help in discharging the charge present on the specific areas of surface 106 of photoconductor system 100 to form the electrostatic latent image thereon.

Accordingly, to inherit the aforementioned property, charge generation layer 104 includes a photosensitive material. The photosensitive material is responsible for the absorption of the light by charge generation layer 104. The photosensitive material includes titanyl phthalocyanine (hereinafter interchangeably referred to as "TiOPC"). The titanyl phthalocyanine used in the present disclosure has the following molecular formula:

$$C_{32}H_{16}N_8OTi$$

Figure 2:
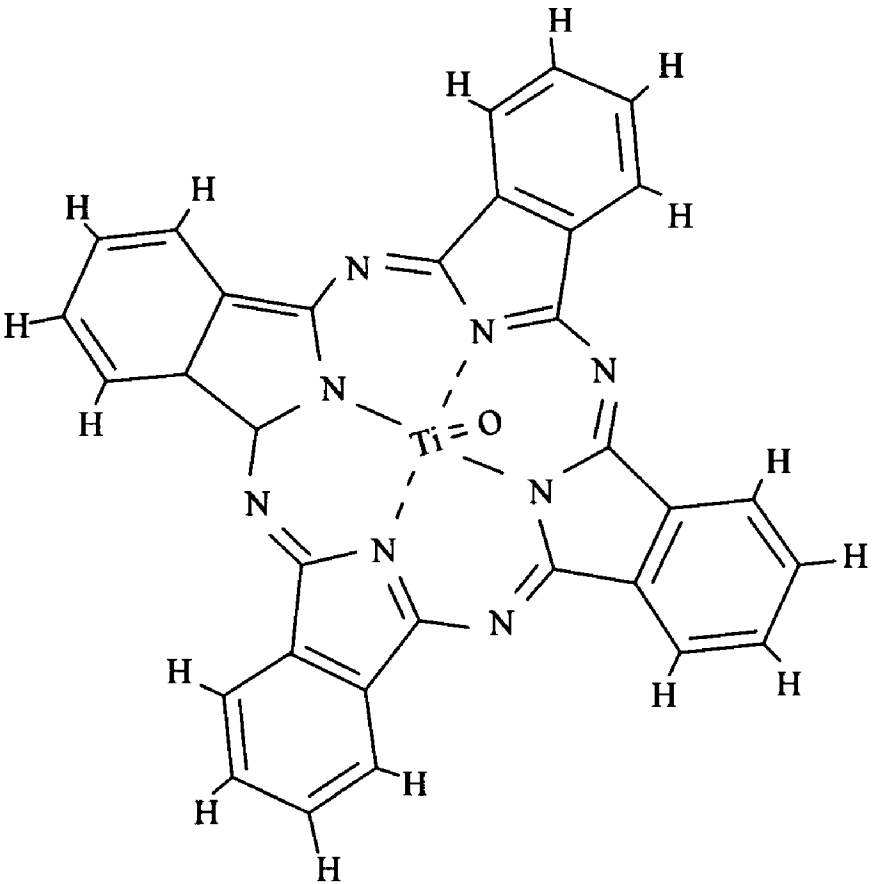
FIG. 2 is a schematic depiction of a molecular structure of titanyl phthalocyanine.

Further, the titanyl phthalocyanine has a molecular weight (MW) of 576.39. Molecular structure of the titanyl phthalocyanine is depicted in FIG. 2. More specifically, the photosensitive material employed in charge generation layer 104 includes a crystalline form of the titanyl phthalocyanine. Even more specifically, the photosensitive material is a type IV titanyl phthalocyanine.

In addition, charge generation layer 104 includes at least one oligomeric phenylene additive. The at least one oligomeric phenylene additive may improve spectral sensitivity of charge generation layer 104. The term "spectral sensitivity," of a charge generation layer, such as charge generation layer 104, refers to an ability of the charge generation layer to respond to irradiation by light.

Figure 3B:
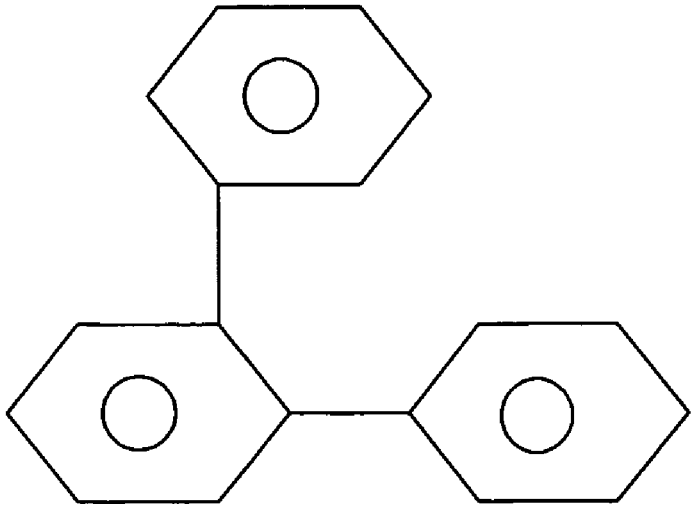
FIG. 3B is a schematic depiction of a molecular structure of ortho-terphenyl.
Figure 3A:
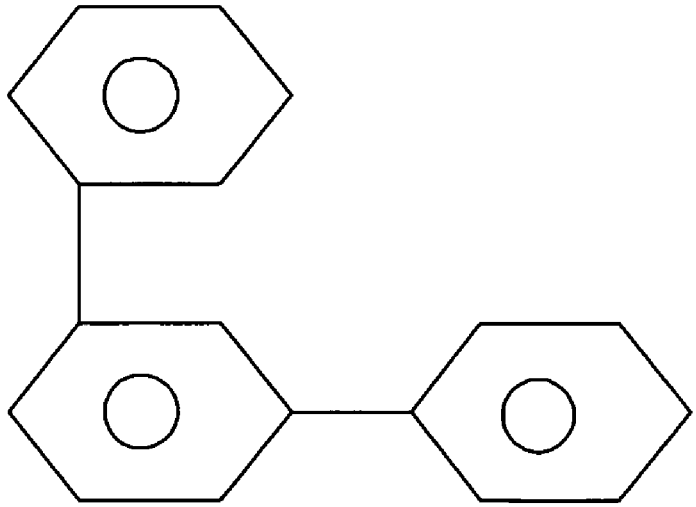
FIG. 3A is a schematic depiction of a molecular structure of meta-terphenyl.

Suitable examples of the at least one oligomeric phenylene additive of the present disclosure include, but are not limited to, biphenyls additives, terphenyls additives, quaterphenyls additives, and combinations thereof. The at least one oligomeric phenylene additive is a terphenyl additive. More specifically, the at least one oligomeric phenylene additive is a terphenyl additive selected from the group consisting of meta-terphenyl (hereinafter interchangeably referred to as "m-terphenyl"), ortho-terphenyl (hereinafter interchangeably referred to as "o-terphenyl"), and a combination thereof. The molecular structure of the meta-terphenyl additive is depicted by FIG. 3A. Further, the molecular structure of the ortho-terphenyl additive is depicted by FIG. 3B.

In addition to the at least one oligomeric phenylene additive, charge generation layer 104 may include at least one binder, which disperses the titanyl phthalocyanine and the at least one oligomeric phenylene additive therewithin. Suitable examples of the at least one binder may include, but are not limited to, polycarbonate resins, polyester resins, polyarylate resins, butyral resins, polystyrene resins, poly (vinyl acetal) resins, diallyl phthalate resins, acrylic resins, methacrylic resins, vinyl acetate resins, phenol resins, silicone resins, polysulfone resins, styrene-butadiene resins, alkyd resins, epoxy resins, urea resins, vinyl chloride-vinyl acetate resins, and combinations thereof.

Photoconductor system 100 further includes a charge transport layer 108 disposed on charge generation layer 104. More specifically, charge transport layer 108 is deposited onto charge generation layer 104 to form a layer thereof, having a particular thickness. For the purpose of this description, the thickness of charge transport layer 108 is adjusted to about 25 microns. It will be apparent to a person skilled in the art that charge transport layer 108 may be coated on charge generation layer 104 and then dried, using techniques similar to those employed for coating charge generation layer 104 onto electroconductive support 102.

Charge transport layer 108 is capable of transferring the charge generated in charge generation layer 104 to surface 106 of photoconductor system 100. More specifically, charge transport layer 108 is capable of transferring the holes generated in charge generation layer 104 to surface 106 of photoconductor system 100, when charge generation layer 104 is irradiated by the light.

Charge transport layer 108 of photoconductor system 100 absorbs negligible amount of the light, which is used for irradiating charge generation layer 104. A negligible absorption of the light by charge transport layer 108 ensures that maximum amount of the light having a wavelength of about 350 nm to about 850 nm, is available to charge generation layer 104 thereby increasing an absorption efficiency thereof. Further, the negligible absorption of the light having a wavelength of about 350 nm to about 850 nm, and more specifically, from about 350 nm to about 500 nm, prevents degradation of charge transport layer 108, which usually occurs when the light has low wavelength. Charge transport layer 108 may also be capable of exhibiting light transmitting properties for the light having a wavelength of about 350 nm to about 850 nm.

Specifically, charge transport layer 108 needs to include a charge transport compound, which is capable of transferring charge, and does not completely absorb the irradiated light. Further, the charge transport compound should be either transparent or semi-transparent to the light having a wavelength of about 350 nm to about 850 nm, and more specifically, of about 350 nm to about 500 nm, and even more specifically, of about 405 nm. Accordingly, charge transport layer 108 of the present invention includes one or more of such charge transport compounds selected from the group consisting of N,N'-diphenyl-N,N'-di(m-talyl)-p-benzidene (TPD), 1,1-bis(di-4-tolylaminophenyl)cyclohexane (TAPC), tritolyamine (TTA), N-(biphenyl-4-yl)-N,N-bis(3,4-dimethyl-phenyl)amine, N-biphenylyl-N-phenyl-N-(3-methyl phenyl)amine, and combinations thereof. Further, charge transport layer 108 may include an ultraviolet absorber, such as hydroxyphenylbenzotriazole (HPBT). Furthermore, charge transport layer 108 may be dispersed in a compliant binder. A suitable example of the compliant binder may include a bis-phenol-z-polycarbonate. However, it should be understood that the aforementioned example of the compliant binder should not be construed as a limitation to the present disclosure. Further, the one or more charge transport compounds may be present in an amount of about 5 percent to about 60 percent by weight in charge transport layer 108.

In another aspect, the present disclosure discloses a charge generation layer, such as charge generation layer 104. As described in conjunction with FIG. 1, charge generation layer 104 includes a photosensitive material comprising titanyl phthalocyanine, and at least one oligomeric phenylene additive. Charge generation layer 104 is capable of absorbing light (such as a laser light or light emitted by a light emitting diode) having a wavelength of about 350 nm to about 850 nm, thereby exhibiting high spectral sensitivities at such wavelengths. Such charge generation layer 104 may be effectively used in an electrophotographic device for producing images with high print resolution, as charge generation layer 104 is capable of exhibiting large absorption of the light having the wavelength of about 350 nm to about 850 nm.

In yet another aspect, the present disclosure provides a method for forming an image in an electrophotographic device. The method includes providing an electrophotographic photoconductor system, such as photoconductor system 100. Photoconductor system 100 includes an electroconductive support, such as electroconductive support 102, a charge generation layer, such as charge generation layer 104, disposed on electroconductive support 102. Further, photoconductor system 100 includes a charge transport layer, such as charge transport layer 108 disposed on charge generation layer 104. As described above, charge generation layer 104 includes a photosensitive material comprising titanyl phthalocyanine, and at least one oligomeric phenylene additive.

The method further includes charging photoconductor system 100 and irradiating photoconductor system 100 with light (such as a laser light or light emitted by a light emitting diode) having a wavelength of about 350 nm to about 850 nm to form an electrostatic latent image on photoconductor system 100. Specifically, photoconductor system 100 may be charged to a specific charging voltage using either a charge corona device, or a charge roller, or any other charging device known in the art. Furthermore the method includes developing the electrostatic latent image with a toner to form a toner image, and transferring the toner image from photoconductor system 100 onto a media sheet to form the image. Suitable examples of the media sheet include, but are not limited to, textile substrates, non-woven substrates, canvas substrates, and cellulose substrates.

The foregoing aspects of the present disclosure may be understood by referring to the following non-limiting example. However, one of ordinary skill in the art, and based on a reading of this detailed description, would recognize that, the specific example is intended to illustrate, not limit, the scope of the present disclosure.

EXAMPLE

In the following example, different electrophotographic photoconductor systems were investigated for use in an electrophotographic device. Each of the different electrophotographic photoconductor systems was prepared by coating a charge generation layer and a charge transport layer onto an electroconductive support (such as an anodized aluminum drum). More specifically, the charge generation layer (in the form of a liquid dispersion) was coated onto the electroconductive support using a dip-coating technique, and then air-dried. The charge generation layer included one or more crystalline forms of TiOPC, such as type IV TiOPC; polyvinylbutyral, poly(methylphenylsiloxane) (PMPS); poly(4-hydroxystyrene) (PHS); and terphenyl additive, in a 92:8 methyl ethyl ketone (MEK)/cylcohexane mixture prepared in an Eiger mill with a final particle size of about 0.17 microns (as explained in Table 1).

Further, the charge transport layer (in the form of a liquid solution) was coated onto the electroconductive support, and more particularly, onto the charge generation layer using a coating technique similar to that employed for coating the charge generation layer onto the electroconductive support.

The charge transport layer (about 20 percent solids) was prepared by dissolving 35 parts by weight of tritolyamine (TTA), 5 parts by weight of 1,1-bis(di-4-tolylaminophenyl) cyclohexane (TAPC), 2 parts by weight of Tinuvin 328 (available from CIBA Chemicals), and 58 parts by weight of polycarbonate Z (PCZ300) in a 75/25 Tetrahydrofuran (THF)/1,4-dioxane mixture. Further, thickness of the charge transport layer was adjusted to about 25 micrometers by altering the speed of coating. In addition, the electroconductive support having the charge generation layer and the charge transport layer was cured after coating the charge transport layer onto the charge generation layer, at about 85 degrees Celsius (° C.) for about 1 hour.

The compositions of the different electrophotographic photoconductor systems that were investigated in the example are enlisted in Table 1, as provided below. The different electrophotographic photoconductor systems included different formulations of the charge generation layer, but included the same formulation of the charge transport layer, as described above. Further, components of the different formulations of the charge generation layers with respect to the different electrophotographic photoconductor systems are listed in parts by weight percent (hereinafter referred to as " wt %").

TABLE 1

| | Charge generation layer (in a 92:8 MEK/cyclohexane solution) | | | | |
|---|---|---|---|---|---|
| Formulation/ Sample | TIOPC IV (wt %) | Poly-vinylbutyral (wt %) | PMPS (wt %) | PHS (wt %) | m-Terphenyl (wt %) |
| Example 1 (S1) | 58.7 | 21.2 | 1.8 | 1.8 | 16.5 |
| Comparative Example 1 (S2) | 58.7 | 28.2 | 4.4 | 8.7 | — |
| Comparative Example 2 (S3) | 45 | 55 | — | — | — |

As it may be observed from Table 1, the sample S1 includes the terphenyl additive. Alternatively, the sample S2 and the sample S3 are comparative examples without any such additives.

The different electrophotographic photoconductor systems (of Table 1) were tested on a QEA PDT-2000LA Advanced Photoconducting Drum/Charge Roller test system (hereinafter referred to as "QEA test system") and an in-house off-line test system (hereinafter referred to as "off-line test system"). More specifically, the different electrophotographic photoconductor systems were irradiated with light in the aforementioned test systems, and responses (in terms of respective discharge energies and residual voltages) of the different electrophotographic photoconductor systems were monitored.

Even more specifically, in the QEA test system, the different electrophotographic photoconductor systems were negatively charged by contacting with a charge corona device to a charging voltage. For the QEA test system, the different electrophotographic photoconductor systems were charged to a charging voltage of about −700 Volts (V). Subsequently, the different electrophotographic photoconductor systems were disconnected from the charge corona device. Thereafter, the different electrophotographic photoconductor systems were irradiated using a 405 nm light emitting diode (LED) based light source, with an expose-to-develop time of about 75 milliseconds. It will be apparent to those skilled in the art that the irradiation of an electrophotographic photoconductor system leads to a discharge (hereinafter referred to as "discharge voltage") at a surface of the electrophotographic photoconductor system.

Figure 4:
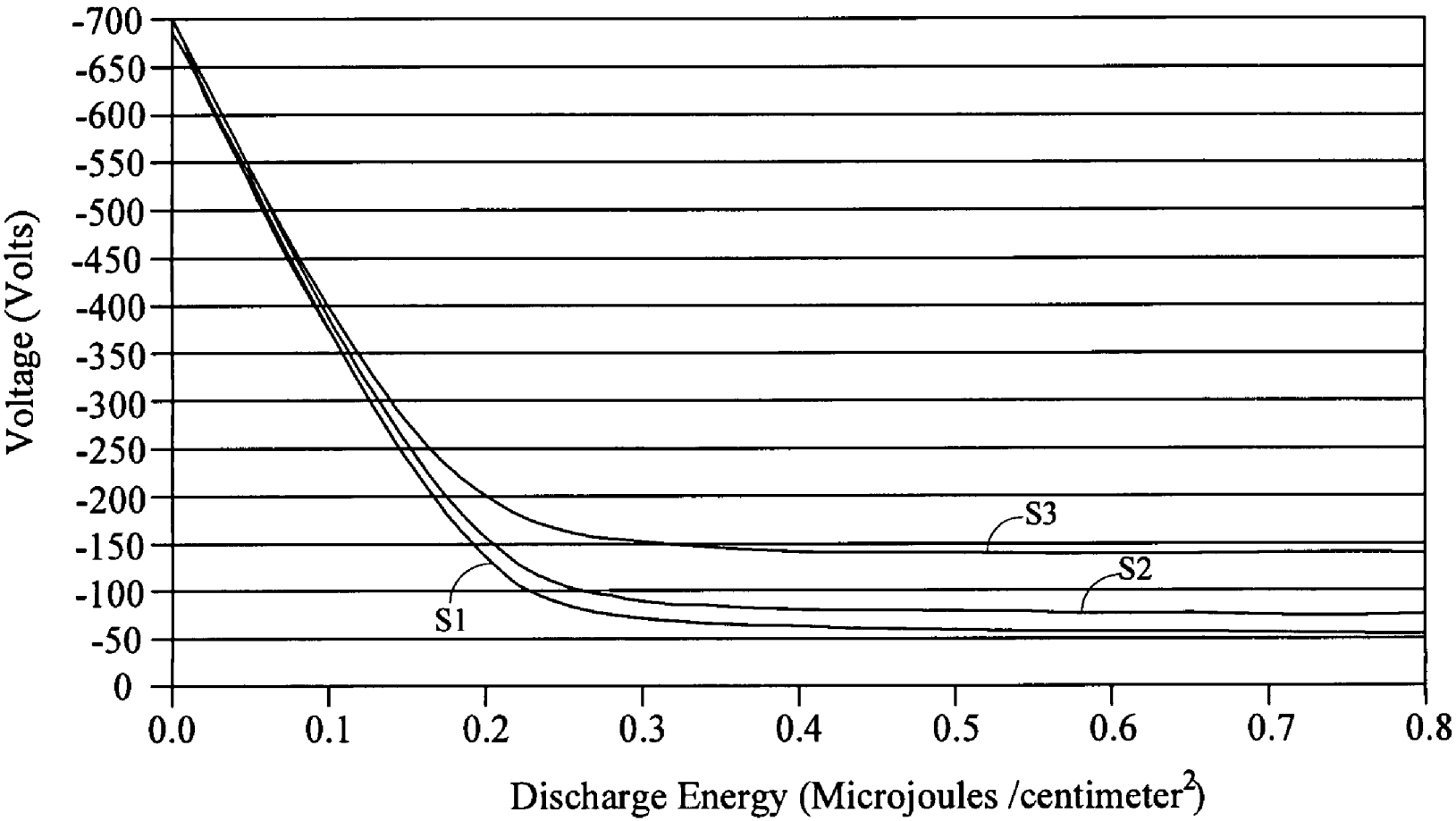
FIG. 4 is a schematic depiction of discharge curves for different electrophotoconductor systems tested in a QEA test system.

Accordingly, values of discharge energies of the different electrophotographic photoconductor systems and the voltages thereof were observed and recorded, over an extended period. Further, the values were plotted to obtain "discharge curves" for the different electrophotographic photoconductor systems. Such discharge curves for the QEA test system are depicted in FIG. 4.

Moreover, values of $E_{1/2}$ were also determined for the different electrophotographic photoconductor systems. The value of "$E_{1/2}$" refers to the value of discharge energy of an electrophotographic photoconductive system required to reach at a voltage that is half of charging voltage. In addition, residual voltages, i.e., the voltages of the different electrophotographic photoconductor systems at the end of the extended period were observed and recorded. Accordingly, the values of $E_{1/2}$ and residual voltages are presented in Table 2.

TABLE 2

| Sample | $E_{1/2}$ (Microjoules/centimeter$^2$) | Residual Voltage (V) |
|---|---|---|
| Example 1 (S1) | 0.11 | −56 |
| Comparative. Example 1 (S2) | 0.11 | −71 |
| Comparative Example 2 (S3) | 0.12 | −140 |

In the off-line test system, the different electrophotographic photoconductor systems were negatively charged by a charge roller to a charging voltage of about −740 V. Thereafter, the different electrophotographic photoconductor systems were irradiated with a laser light having a wavelength of about 780 nm for about 68 milliseconds.

Figure 5:
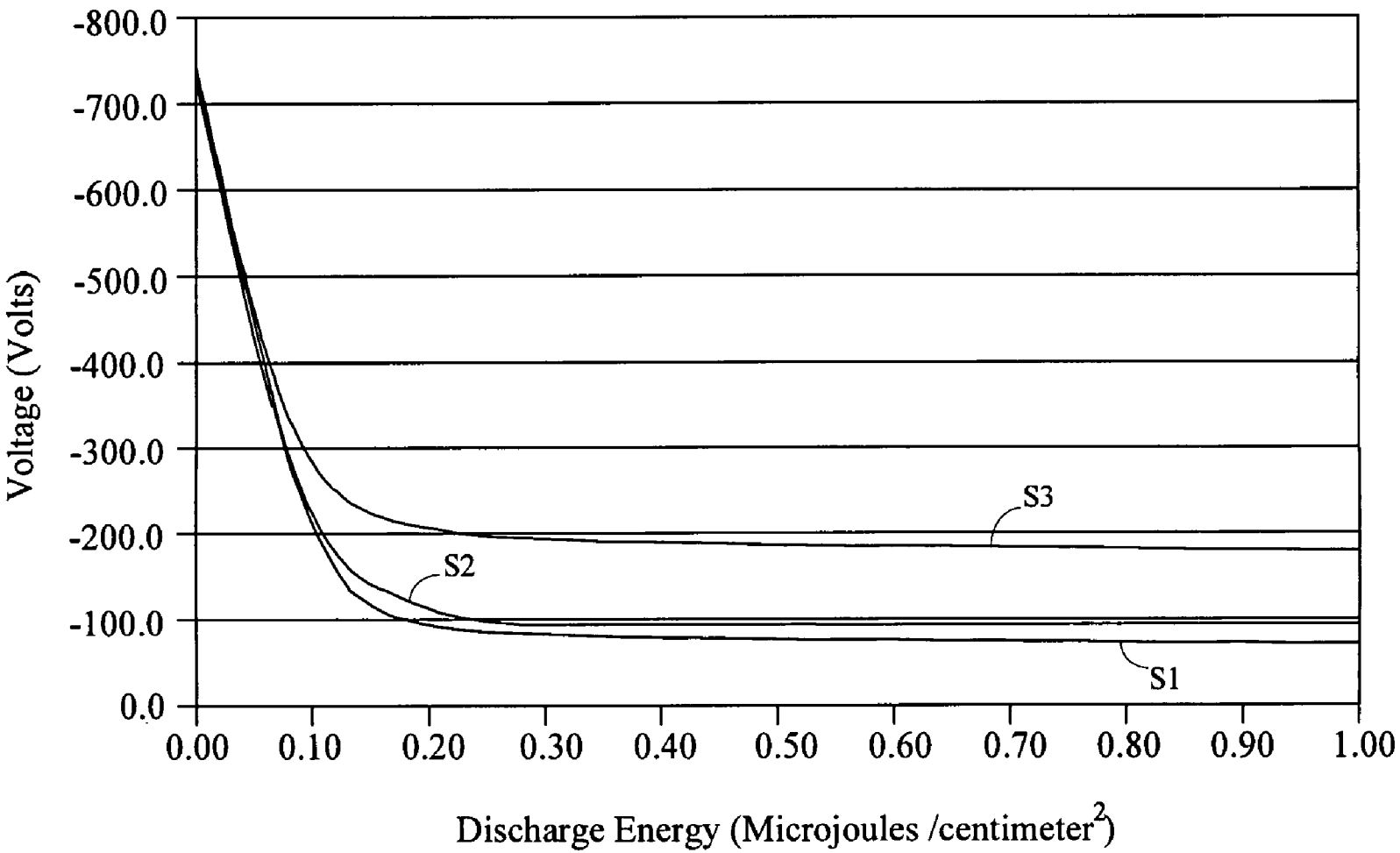
FIG. 5 is a schematic depiction of discharge curves for different electrophotoconductor systems tested in an in-house off-line test system.

Accordingly, values of discharge energies of the different electrophotographic photoconductor systems and the voltages thereof were observed and recorded. The values were plotted to obtain discharge curves (as depicted in FIG. 5) for the off-line test system. Further, the values of $E_{1/2}$ and residual voltages for the different electrophotographic systems were determined. The values of $E_{1/2}$ and residual voltages are presented herein below in Table 3.

TABLE 3

| Sample | $E_{1/2}$ (Microjoules/centimeter$^2$) | Residual Voltage (V) |
|---|---|---|
| Example 1 (S1) | 0.063 | −72 |
| Comparative Example 1 (S2) | 0.064 | −86 |
| Comparative Example 2 (S3) | 0.070 | −178 |

As observed from Table 2 and FIG. 4, in the QEA test system, the sample S1 and the sample S2 exhibit almost the same value of $E_{1/2}$. However, it may be observed that the sample S1 exhibits a lower value of residual voltage as compared to the sample S2. Further, the sample S3 exhibits a higher value of $E_{1/2}$ as compared to the sample S1 and the sample S2. In addition, the sample S3 exhibits a higher value of residual voltage (about −140 V) as compared to the sample S1 (exhibiting about −56 V). Moreover, as observed from Table 3 and FIG. 5, in the off-line test system, the sample S1 exhibits a lower value of $E_{1/2}$ as opposed to the values of $E_{1/2}$ for the sample S2 and the sample S3. In addition, the sample S1 exhibits a lower residual voltage as compared to the sample S2 and the sample S3.

Accordingly, the sample S1, which includes the electrophotoconductor system according to the present disclosure, exhibits a better spectral sensitivity at wavelength ranging from about 350 nm to about 850 nm, as compared to the sample S2 and the sample S3. Moreover, the sample S1 exhibits a much smaller value of residual voltage as compared to the sample S2 and the sample S3.

Based on the forgoing, the present disclosure provides an electrophotographic photoconductor system, such as electrophotographic system 100, for use in an electrophotographic device. The electrophotographic photoconductor system includes an electroconductive support, a charge generation layer disposed on the electroconductive support, and a charge transport layer disposed on the charge generation layer. The charge generation layer includes a photosensitive material that includes titanyl phthalocyanine, and at least one oligomeric phenylene additive. The electrophotographic system exhibits a large absorption of light having a wavelength of about 350 nm to about 850 nm. In addition, the use of the at least one oligomeric phenylene additive (and more specifically, terphenyl additive) in the electrophotographic system helps to provide an improved spectral sensitivity for light having a wavelength of about 405 nm. Further, the charge transport layer of the electrophotographic system absorbs minimum amount of the light thereby preventing the degradation thereof. In addition, the electrophotoconductor system produces high resolution images when employed in the electrophotographic device.

The foregoing description of several embodiments and methods of the present invention have been presented for purposes of illustration. It is not intended to be exhaustive or to limit the present invention to the precise steps and/or forms disclosed, and obviously many modifications and variations are possible in light of the above teaching. It is intended that the scope of the present invention be defined by the claims appended hereto.

What is claimed is:

1. A charge generation layer for an electrophotographic device, the charge generation layer comprising:

a photosensitive material comprising type IV titanyl phthalocyanine; and at least one oligomeric phenylene additive including quaterphenyls, wherein the charge generation layer absorbs light having a wavelength of about 350 nm to about 850 nm.

2. The charge generation layer of claim 1 further comprising at least one binder.

3. The charge generation layer of claim 2 wherein the at least one binder is a binder resin selected from the group consisting of polycarbonate resins, polyester resins, polyarylate resins, butyral resins, polystyrene resins, poly (vinyl acetal) resins, diallyl phthalate resins, acrylic resins, methacrylic resins, vinyl acetate resins, phenol resins, silicone resins, polysulfone resins, styrene-butadiene resins, alkyd resins, epoxy resins, urea resins, vinyl chloride-vinyl acetate resins and combinations thereof.

4. The charge generation layer of claim 1 wherein the at least one oligomeric phenylene additive further includes biphenyls, terphenyls, or combinations thereof.

5. The charge generation layer of claim 4 wherein the at least one oligomeric phenylene additive further includes meta-terphenyl, ortho-terphenyl or a combination thereof.

* * * * *